US005469720A

United States Patent [19]

Paggi

[11] Patent Number: 5,469,720

[45] Date of Patent: Nov. 28, 1995

[54] MACHINE FOR DYEING FABRICS WOUND UP INTO ENDLESS FABRIC LOOPS

[75] Inventor: Roberto Paggi, Milan, Italy

[73] Assignee: Paggi S.r.l., Italy

[21] Appl. No.: 268,248

[22] Filed: Jun. 29, 1994

[30] Foreign Application Priority Data

Jul. 8, 1993 [IT] Italy ..... MI93A1474

[51] Int. Cl.[6] ..... D06B 3/28

[52] U.S. Cl. ..... 68/13 R; 68/178; 68/184; 226/30; 226/118

[58] Field of Search ..... 68/9, 13 R, 22 R, 68/27, 176, 177, 178, 184; 226/4, 14, 30, 104, 118

[56] References Cited

U.S. PATENT DOCUMENTS

| | | | |
|---|---|---|---|
| 3,700,404 | 10/1972 | Janisch et al. | 68/22 R X |
| 3,830,084 | 8/1974 | Caputi | 68/178 |
| 3,848,438 | 11/1974 | Tachibana et al. | 68/22 R |
| 4,006,612 | 2/1977 | Thies | 68/177 |
| 4,107,801 | 8/1978 | Tachibana | 68/176 X |
| 4,207,759 | 6/1980 | Barriquand | 68/177 X |
| 4,291,555 | 9/1981 | Barriquand | 68/177 X |
| 5,239,719 | 8/1993 | Ware | 68/178 X |

*Primary Examiner*—Philip R. Coe

*Attorney, Agent, or Firm*—Shlesinger, Fitzsimmons & Shlesinger

[57] ABSTRACT

The present invention provides a machine for dyeing fabrics wound up into cords using the overflow or jet system, comprising two or more overflow or jet units arranged in series in a single tank, in which the speed of the various reels of each overflow or jet device is synchronised with respect to a driving reel by affixing permanent magnets to the fabric and appropriate sensors on the machine so that possible slipping of the fabric can be corrected by a microprocessor drive control system.

9 Claims, 2 Drawing Sheets

MACHINE FOR DYEING FABRICS WOUND UP INTO ENDLESS FABRIC LOOPS

Figure 1:
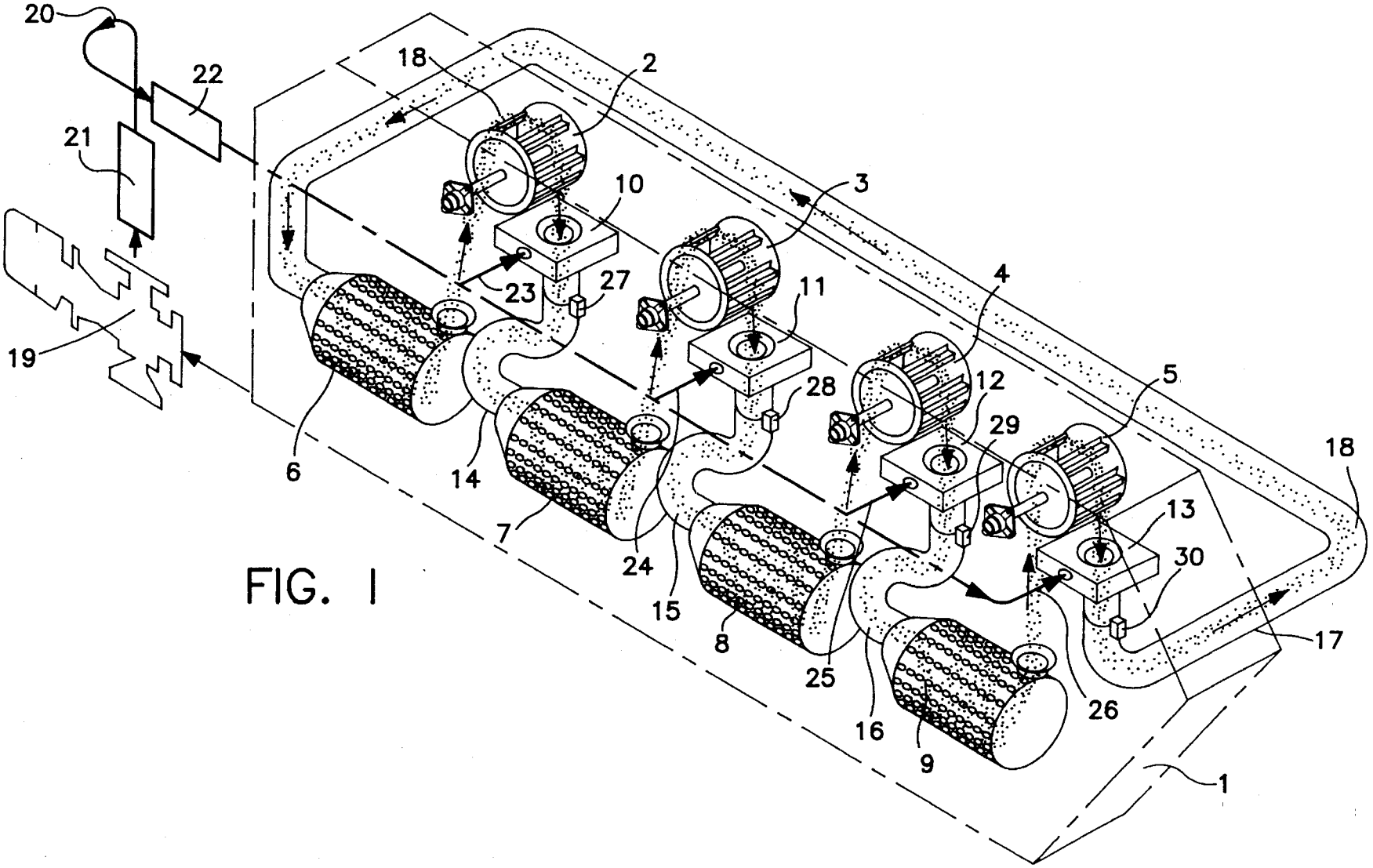

This invention relates to the art field of machines for dyeing fabrics wound up into cords or endless fabric loops with the overflow or jet system or with a combined overflow and jet system. More particularly, the invention discloses a machine for dyeing fabrics wound up into cords by means of the passage of the fabric through two or more overflow or jet devices arranged in series.

Prior art envisages overflow or jet machines for dyeing fabrics wound up into cords, essentially comprising a reel that lifts the fabric, in a closed loop, from the underlying collection tank and:

in the case of the overflow system, introduces the fabric into a funnel into which the dyebath liquor is poured and circulated by means of a pump and heated by virtue of its passage through a heat exchanger before reaching the overflow funnel. The funnel is followed by a tube through which the fabric floats and is caused to advance by the flow of dyebath liquor arriving from the funnel before falling into the tank where it is arranged in layers or allowed to accumulate; it is then picked up by the reel. After a certain number of passages through the overflow funnel, and after having been immersed in the dyebath at an increasingly high temperature, the dyed fabric is extracted from the machine. The overflow system is generally utilised for delicate fabrics so the procedure is slow in that the pressure at which the dyebath liquor is directed against the fabric is the same pressure as that resulting from the pouring of the fluid into the funnel so the fabric moves very slowly through the machine.

in the case of the jet dyeing system, which is used for more resistant fabrics, the fabric is subjected to a pressurised jet of dyebath liquor in a similar machine to the overflow dyeing machine, so that it circulates at considerably higher speed than the speed obtained in the overflow system and, since dyeing is completed after a certain number of passages of the fabric through the overflow or jet device, the greater the speed of translation, the fewer the dyeing passages required.

Machines employing the foregoing systems are able, in addition to dyeing, to perform other dyeshop operations such as washing, stripping, bleaching, and so forth.

Prior art also envisages so-called continuous machines comprising several overflow or jet devices arranged in series, whereby the fabric is fed in at the start of the series and withdrawn at the end; such systems are only used for washing, stripping or bleaching and so forth; they are not suitable for dyeing because a single passage of the fabric through more than one overflow or jet machine is insufficient to cause the fabric to absorb the amount of dyebath liquor required to dye it to a uniform colour. Moreover, it is recognised by all experts in the art field that the transfer of dyestuff to fabric, that is the actual dyeing operation, occurs each time the fabric passes through the overflow or jet device.

On the basis of these considerations, it was conceived that installing a multiplicity of overflow or jet devices in series in a single tank, and circulating the fabric, previously arranged with its ends joined to form a loop, several times, would result in a corresponding significant reduction of the time required for the dyeing process.

The problem with this concept lay in the difficulty of synchronising the various overflow or jet machines in such a way that the fabric would remain uniformly subdivided between the various overflow or jet devices in the machine, because of the frequent accidental slipping between the fabric wound up into cords and the corresponding driving reel during the process so that up to the present day this limitation prevented the construction of overflow or jet dyeing machines with two or more units arranged in series.

This problem is solved by the present invention, whereby it is possible to build a machine formed of several overflow or jet devices arranged in series, in which the fabric in a closed loop, divided between the number of overflow or jet devices in the machine, passes sequentially through the two or more overflow or jet devices as many times as required to dye it, while conserving its subdivision throughout the process.

The invention consists in a machine comprising two or more overflow or jet devices arranged in series in a single tank in which the speed of the various reels of each overflow or jet device is synchronised with respect to a driving reel (denominated "master" in current international terminology) so that any slipping of the fabric on any of the dependent reels (denominated "slaves" in current international terminology), with resulting alterations of the fabric feed speed on any of the slave overflow or jet devices with respect to the master overflow or jet speed, is corrected by the microprocessor machine control unit. This is achieved during the preparatory stages by affixing to the fabric to be dyed, subdivided into an identical number of equal sections as there are overflow or jet devices in the machine, an identical number of permanent magnets, and by installing a sensor that transmits a signal when the magnet transits the position, externally to each overflow or jet device at the fabric infeed position. The sensor signal is received by the microprocessor control device which, whenever necessary, uses previously known techniques to alter the speed of the slave reel to retard it or advance it with respect to the master reel in such a way as to ensure that the various magnets transit simultaneously through all the overflow or jet units in the machine, and consequently to ensure that an equal length of fabric passes through each overflow or jet unit in the machine within the same interval of time.

The foregoing signals, which are generated by the successive passage of the permanent magnets through the various overflow or jet devices, also serve to inform the machine control unit of the number of passages of the fabric and thence to automatically adjust also the extent of temperature increase of the dyebath liquor, also when the translation speed of the fabric is increased or decreased during the course of the dyeing proces. A description is provided of two preferred embodiments as shown in the two attached figures, chosen for the purposes of illustration, although it should be understood that numerous changes could be made in the design of the system without departing from the spirit and scope of the inventive concepts described.

Figure 2:
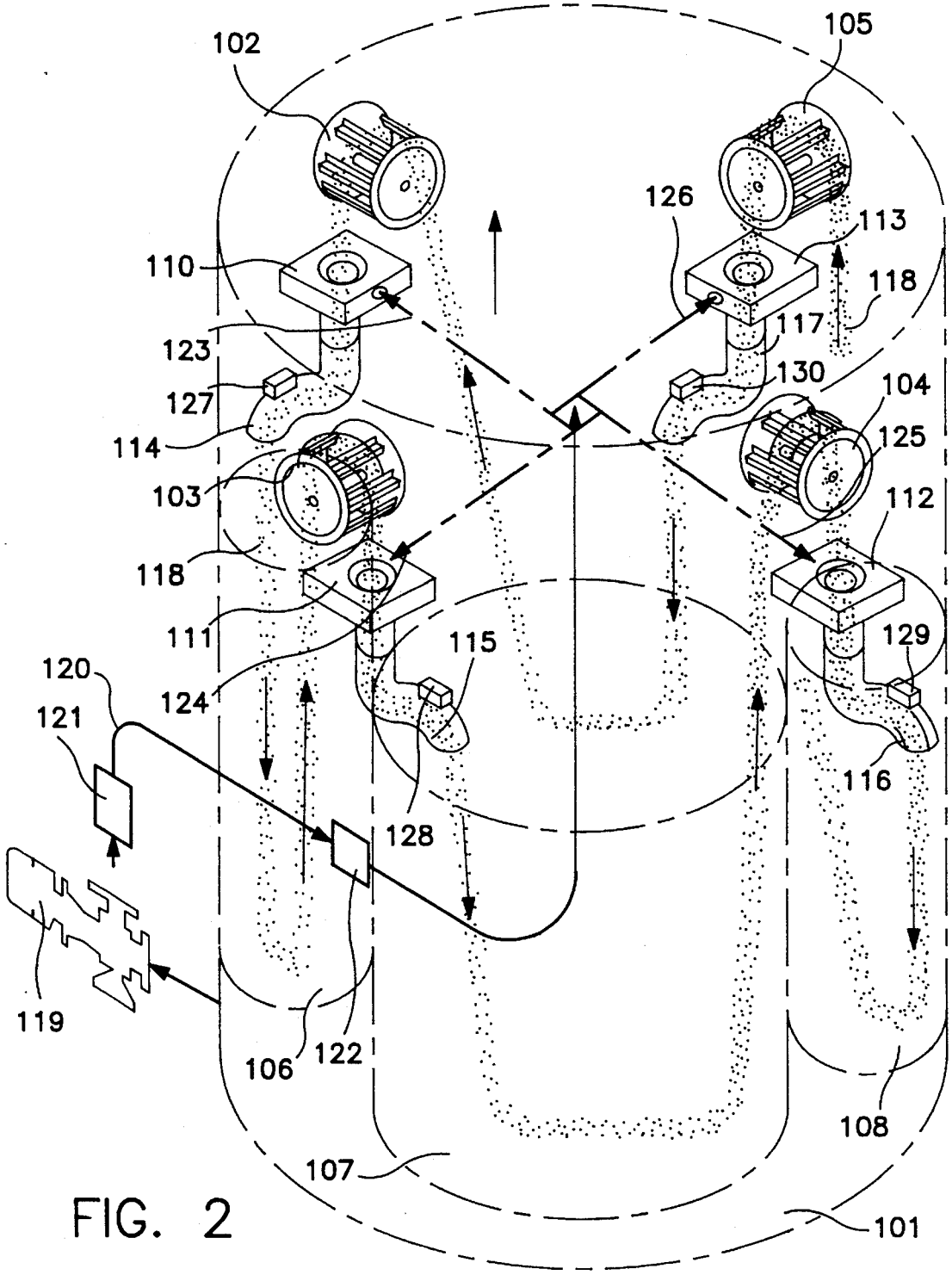

The figures show the following:

FIG. 1 - a perspective view of a machine as envisaged by the invention with the various component devices disposed in a linear configuration;

FIG. 2 - a perspective view of a machine as envisaged by the invention in a vertical version with the various devices making up the machine disposed in a circular configuration.

With reference to FIG. 1, numeral (1) is the dye tank containing overflow or jet devices, said tank having a parallelepided shape designed to house overflow or jet dyeing devices. Internally to the tank there is arranged a series of reels designated (2), (3), (4), and (5), arranged in a linear configuration.

In the example there are four devices although there could be an unspecified number in accordance with the needs and requirements of the user.

The said reels (2), (3), (4), and (5) are positioned between an identical number of fabric collection tanks (6), (7), (8), and (9) and, respectively, an identical number of overflow funnels (10), (11), (12), and (13) located on the respective pipelines (14), (15), (16), and (17).

The reels (2), (3), (4) and (5) pick up the fabric (18) held in the tanks (6), (7), (8) and (9) and insert it into the respective overflow devices (10), (11), (12) and (13) i.e., the in fabric in tank (6) is inserted into overflow device (10), the in fabric in tank (7) is inserted into overflow device (11), the in fabric in tank (8) is inserted into overflow device (12) and the fabric in tank (9) is inserted into overflow device (13), and from this position, it transits through overflow pipeline (17) from where it returns to tank (6).

The example envisages overflow devices, but as mentioned above, also jet devices or combined overflow-jet devices can be used if it is decided to apply the invention to these types of dyeing systems.

A pump (19) sucks up the dyebath liquor from the bottom of tank (1) and forces it into a pipe (20) and, after having passed the liquor through a filter (21) and a heat exchanger (22) it routes the liquor through pipeline (20) simultaneously though the parallel branches (23), (24), (25) and (26) to the four overflow devices (10), (11), (12) and (13).

Inside each overflow funnel (10), (11), (12) and (13), preferably located downstream of the insertion point of the fabric (18), there are positioned an identical number of sensors (27), (28), (29) and (30), connected to the microprocessor control device supervising the various operations to be performed in accordance with the programmed processing cycle.

Before insertion into the tank, the fabric, which is divided into the same number of equal length sections as there are overflow units in the machine (four in the example) is fitted with an identical number of permanent magnets.

FIG. 2 shows the device arranged in a vertical configuration with the overflow reel units in a circular rather than linear layout.

In the figure, numeral (101) is a circular shape tank designed to operate with overflow or jet devices disposed vertically.

A series of reels (102), (103), (104) and (105) are arranged in sets of two according two diameters disposed orthogonally with respect to each other.

There are four reels in the example, although this number may be varied in accordance with the requirements of the user.

The said reels (102), (103), (104) and (105) are positioned in correspondence with an identical number of collection tanks (106), (107), (108) and (109) (not shown in the figure) and an identical number of overflow funnels (110), (111), (112), and (113) positioned on the respective pipelines (114), (115), (116) and (117).

The reels (102), (103), (104) and (105) pick up the fabric (118) contained in the collection tanks (109), (106), (107) and (108) and introduce it into the respective funnels (110), (111), (112) and (113) as follows: the fabric in collection tank (106) is inserted into overflow device (110), the fabric in collection tank (107) is inserted into overflow device (111), the fabric in collection tank (108) is inserted into overflow device (112) and the fabric in collection tank (109) is inserted into overflow device (113).

The example considers the use of overflow devices, but also in this case either jet systems or combined overflow-jet systems can be used if these types of dyeing systems are preferred.

A pump (119) sucks up the dyebath liquor from the bottom of tank (101) and forces it into a pipeline (120) where, after having forced it through a filter (121) and a heat exchanger (122), it routes it through the branch lines (123), (124), (125) and (126) arranged in parallel to the four overflow devices (110), (111), (112) and (113).

Externally to each overflow funnel (110), (111), (112) and (113), preferably located immediately downstream of the point in which the fabric (118) is introduced, there are located an identical number of sensors (127), (128), (129) and (130) connected to the microprocessor control unit supervising the various operations carried out in accordance with the programmed processing cycle. Before being inserted into the tank, the rope, which is divided into the same number of equal length sections as there are overflow units in the machine (four in the example) is fitted with an identical number of permanent magnets.

The system operates in the following manner.

The fabric 18 (118) is divided into the same number of sections as there are overflow or jet units in the machine: in the example there are four units. Four permanent magnets are affixed to the fabric, divided into four equal length sections, the fabric is inserted into the machine wound up into cords and the two ends of the fabric are stitched together to form a loop. The required quantity of dyebath liquor, in consideration of the dimensions of the tank and the length of the fabric to be dyed, is caused to flow into the tank by means of the pump 19 (119); the liquid is pumped through the heat exchanger in order to heat it to the required starting temperature for the dyeing process.

The required processing cycle is programmed on the microprocessor control unit and the machine is set into operation in accordance with the previously memorized fabric translation speed referred to the driving reel which, in the example in question, is reel 5 (105).

The microprocessor now switches on and performs the following operations by means of suitable software:

- controls the speed of the driven reels in accordance with the signals that sensors 27 (127), 28 (128) 29 (129) and 30 (130) transmit on the passage of each magnet in relation to the speed of driving reel 5 (105);
- adjusts the delivery rate of the pump;
- transmits suitable signals for the introduction of additional dyestuff (if needed) and/or any other chemical products required for the dyeing process, this operation being performed on the basis of the passages of the fabric through the overflow units, as detected by the passage of the permanent magnets across the relative sensors, duly stored in the microprocessor memory.

This sequence of events continues until the cycle is completed. The benefits that derive from the application of the invention—use of several overflow or jet devices arranged in series contrarily to previously known methods which envisage a single overflow or jet device—are numerous:

- very fast treatment times;
- improved preservation of the treated material because the total cycle time is reduced;
- simultaneous delivery to two or more overflow or jet devices of chemical additives or dyestuffs that allows to improve the temperature gradient and increase the uniformity of colouring;
- the possibility of loading very long fabrics without having to use high circulation speeds that could lead to damage and uneven dyeing;

perfect uniformity of colouring thanks to the large scale interchange of dyebath liquor and fabric obtained by using a series of overflow or jet dyeing devices.

I claim:

1. In a machine for dyeing fabrics wound into endless fabric loops, including a dyebath tank containing dyebath liquor, a plurality of overflow or jet devices arranged in a series in said tank, a like plurality of reels associated with said devices for feeding a fabric loop successively through the devices in said series thereof, a pump for circulating dyebath liquor from said tank through said devices, and a microprocessor control unit for driving one of said reels at a predetermined speed, and the remainder of said reels at speeds determined by signals generated during the passage of said fabric loop through said devices, the improvement comprising means for monitoring the rate at which the fabric loop to be dyed passes through each of said devices, said monitoring means including a plurality of signal generating elements equal in number to said devices, said signal generating elements being secured to said fabric loop at equispaced intervals therealong for travel therewith through said devices, and a signal sensor mounted on each of said devices to sense and relay a signal to said microprocessor control unit each time one of said signal generating elements passes one of said sensors, the relayed signals being operative to cause said microprocessor control unit to synchronize the speed of rotation of said other reels with the speed of rotation of said one reel, so that it will take the same interval of time for each section of the fabric loop between an adjacent pair of said signal generating elements to pass through each of said devices.

2. A machine as defined in claim 1, wherein each of said signal generating elements comprises a permanent magnet.

3. A machine for dyeing fabrics as in claim 2, wherein the signals generating by the successive passages of the permanent magnets through said devices are received by the machine microprocessor control unit in such a way that the temperature of the dyebath liquor, the delivery rate of the pump and also the addition of dyestuff or other products necessary to the dyeing process, are automatically adjusted in accordance with the passages of the fabric through said devices.

4. A machine for dyeing fabrics as in claim 2, characterized in that a fabric collection tank is associated with each of said reels and said overflow or jet devices, and said reels operate to pick up the fabric contained in said collection tanks and feed it into one of said overflow or jet devices.

5. A machine for dyeing fabrics as in claim 4, characterized in that each of said magnets is positioned internally of its associated overflow or jet device downstream of the point in which the fabric is introduced into the device.

6. A machine for dyeing fabrics as in claim 2, characterized in that said pump sucks up the dyebath liquor from the bottom of said dyebath tank and forces it by a pipeline through a filter and a heat exchanger, and then simultaneously through parallel branch pipe lines to said overflow or jet devices.

7. A machine for dyeing fabrics as in claim 2, characterized in that said dyebath tank comprises a circular tank with said overflow or jet devices disposed therein vertically, said reels are arranged in sets of two with the two diameters thereof disposed orthogonally to each other, and are positioned in correspondence with two collection tanks and an identical number of said overflow or jet devices, said reels being operative to pick up the fabric held in said collection tanks and to feed it into the respective devices.

8. A machine for dyeing fabrics as in claim 7, wherein said pump sucks up the dyebath liquor from the bottom of said dyebath tank and forces it by a pipeline through a filter and a heat exchanger, and characterized in that the dyebath liquor is simultaneously caused to flow through parallel branch lines of said pipeline to said overflow or jet devices.

9. A machine for dyeing fabrics as in claim 8, characterized in that said magnets are positioned externally to each said overflow or jet devices and immediately downstream of the point of introduction of the fabric into a respective one of said devices.

* * * * *